US008807355B2

(12) United States Patent
Merey

(10) Patent No.: US 8,807,355 B2
(45) Date of Patent: Aug. 19, 2014

(54) EXPANDIBLE CONTAINER

(76) Inventor: Thomas B. Merey, Port Hope (CA)

( * ) Notice: Subject to any disclaimer, the term of this patent is extended or adjusted under 35 U.S.C. 154(b) by 41 days.

(21) Appl. No.: 13/507,428

(22) Filed: Jun. 28, 2012

(65) Prior Publication Data

US 2014/0001134 A1 Jan. 2, 2014

(30) Foreign Application Priority Data

Jun. 28, 2012 (CA) ..... 2744679

(51) Int. Cl.

| | |
|---|---|
| ***A47F 5/00*** | (2006.01) |
| ***A47B 88/20*** | (2006.01) |
| ***A47B 57/58*** | (2006.01) |
| ***B65D 21/08*** | (2006.01) |
| ***B65D 21/06*** | (2006.01) |

(52) U.S. Cl.

CPC ..... *A47B 88/20* (2013.01); *A47F 5/005* (2013.01); *A47B 57/58* (2013.01); *B65D 21/086* (2013.01); *B65D 21/068* (2013.01)

USPC ..... 211/175; 211/184; 312/348.3; 312/205; 220/8

(58) Field of Classification Search

CPC ..... A47F 5/005; A47F 5/10; A47F 96/04; A47F 3/14; A47B 57/58; A47B 88/20; A47B 57/586; A47B 57/583; A47B 7/144; A47B 45/00; A47B 96/025; A47B 96/04; A47B 2088/202; A47B 2088/20; A47B 2210/07; B65D 21/0233; B65D 21/0237; B65D 21/06; B65D 1/36; B65D 21/086; B65D 1/0292; B65D 21/068; B65D 21/08; B65D 2543/00296; B65D 88/58; B65D 88/60; B65D 88/62; B65D 25/04; B65D 25/06; B65D 5/48; B65D 5/48024; B65D 5/48038; B31B 2217/10; B31B 2217/103; B31B 2217/105

USPC ..... 211/184, 175, 43, 183; 108/60, 61; 312/348.3, 205, 291; 206/514, 553, 206/214, 371, 557, 561; 220/8, 500, 530, 220/534, 551, 529, 552

See application file for complete search history.

(56) References Cited

U.S. PATENT DOCUMENTS

| | | | | | |
|---|---|---|---|---|---|
| 958,857 | A | * | 5/1910 | Dennis | 220/8 |
| 1,212,948 | A | | 1/1917 | Hesse | |
| 1,746,720 | A | | 2/1930 | Sullivan | |
| 2,161,624 | A | * | 6/1939 | Hoerr | 220/551 |
| 2,732,091 | A | | 1/1956 | Kass | |
| 2,840,257 | A | | 1/1958 | Zen | |
| 2,907,487 | A | * | 10/1959 | Harrington | 220/8 |
| 3,003,840 | A | * | 10/1961 | Katzin | 312/298 |
| 3,722,735 | A | * | 3/1973 | Herolzer | 206/506 |
| 4,889,253 | A | * | 12/1989 | Schmulian et al. | 220/551 |
| 5,016,772 | A | * | 5/1991 | Wilk | 220/8 |
| 5,385,230 | A | * | 1/1995 | Nygard et al. | 206/214 |

(Continued)

*Primary Examiner* — Jennifer E Novosad

(57) ABSTRACT

A rectangular expandible container has lateral compartments each of which being composed of inner and outer panels which slide relative to each other for lengthening and shortening the effective length of the compartments. The container also has front and back compartments defined by sliding panels for lengthening the effective width of the front and back compartments. A middle compartment is surrounded by the lateral compartments and the front and back compartments. The walls of the middle compartment are all slidable for lengthening both the width and the length of the latter compartment. The front and back compartment may contain partitions which separate the interior of those compartments into a number of sub-compartment of differing sizes for accommodating articles of varying sizes both in length and in width.

15 Claims, 8 Drawing Sheets

(56) References Cited

U.S. PATENT DOCUMENTS

| | | | | |
|---|---|---|---|---|
| 5,584,412 | A * | 12/1996 | Wang | 220/500 |
| 5,783,245 | A | 7/1998 | Simpson | |
| 5,887,961 | A | 3/1999 | Rosenberg | |
| 5,996,749 | A * | 12/1999 | Hillsberg et al. | 190/109 |
| 6,073,794 | A * | 6/2000 | Bidot | 220/529 |
| 6,129,433 | A * | 10/2000 | Rosenberg et al. | 312/348.3 |
| 6,305,567 | B1 | 10/2001 | Sulpizio | |
| 6,467,622 | B1 * | 10/2002 | Hull | 206/553 |
| 6,834,924 | B2 * | 12/2004 | Hollenstein | 312/348.3 |
| 6,871,921 | B2 * | 3/2005 | Ernst | 312/348.3 |
| 6,991,307 | B2 | 1/2006 | Hoenig | |
| 7,066,563 | B2 * | 6/2006 | Berger | 312/348.3 |
| 7,147,120 | B2 * | 12/2006 | Rosenberg et al. | 220/8 |
| 7,163,119 | B2 * | 1/2007 | Besselman | 220/551 |
| 7,380,894 | B2 * | 6/2008 | Berger | 312/348.3 |
| 7,594,706 | B2 * | 9/2009 | Styka et al. | 312/228 |
| 8,317,040 | B2 * | 11/2012 | Lanning | 211/184 |
| 2004/0004420 | A1 * | 1/2004 | Pine et al. | 312/348.3 |
| 2004/0145287 | A1 * | 7/2004 | Ernst | 312/348.3 |
| 2004/0245254 | A1 | 12/2004 | Rosenberg | |
| 2007/0159040 | A1 * | 7/2007 | Fernandez et al. | 312/348.3 |
| 2008/0083753 | A1 * | 4/2008 | Escobar et al. | 220/8 |
| 2008/0202976 | A1 * | 8/2008 | Burgess et al. | 206/558 |

* cited by examiner

EXPANDIBLE CONTAINER

This application claims priority pursuant to 35 U.S.C. 119 of Canadian application No. 2,744,679, filed Jun. 28, 2012, the entire contents of which are hereby incorporated by reference in their entirety.

FIELD OF THE INVENTION

This invention relates to expandible containers and more particularly to an expandible container containing one or more compartments. Where the container contains more than one compartment, the compartments can be of differing sizes. As a result, the container is particularly suitable as a drawer organizer for accommodating articles of varying sizes both in length and in width.

BACKGROUND OF THE INVENTION

When the expandible container is used as a drawer organizer, the container expands to fit into most conventional drawers found in kitchens and bathrooms. The components of the container can be interlocked to immobilize them so that the container remains firmly in position in the drawer. The container can be provided with a bottom wall or floor which confines any food particles or other undesirable particles within the container. Cleaning of the container can be accomplished simply by removing it from the drawer and washing it under a tap.

A drawer organizer which lacks a bottom wall usually cannot so easily be cleaned. The organizer must first be removed from the drawer, then the particles which remain in the drawer must be removed by wiping the inside walls of the drawer with a cloth. However in wiping the walls, some of the particles will be pushed into the cracks and into the corners between the floors and walls and between adjacent walls of the drawer organizer and remain there. It may be impossible to remove those particles without taking the drawer apart and in doing so the drawer may be damaged.

The expandible container when used as a drawer organizer can be provided with compartments some of which expand in width, some in length and one in both width and length. The container accordingly accommodates various shaped articles some of which are relatively long such as knives, some of which are relatively wide such as forks and some which are both long and wide such as serving spoons.

SUMMARY OF THE INVENTION

The adjustable container when used as a drawer organizer includes an outer perimeter enclosed at its sides by a pair of first lateral walls and at its front and back by substantially parallel first front and first back walls each being adjustable in effective length. A pair of lateral rectangular compartments is disposed within the perimeter and each is of adjustable length. Front and back rectangular compartments are disposed within the perimeter and each has an adjustable width. A middle rectangular compartment is disposed adjacent to the lateral compartments and the front and back compartments and it has both an adjustable length and an adjustable width.

DESCRIPTION OF THE DRAWINGS

The adjustable container of the invention is described with reference to the accompanying drawings in which.

Like reference characters refer to like parts throughout the description of the drawings.

DESCRIPTION OF PREFERRED EMBODIMENTS

Figure 1:
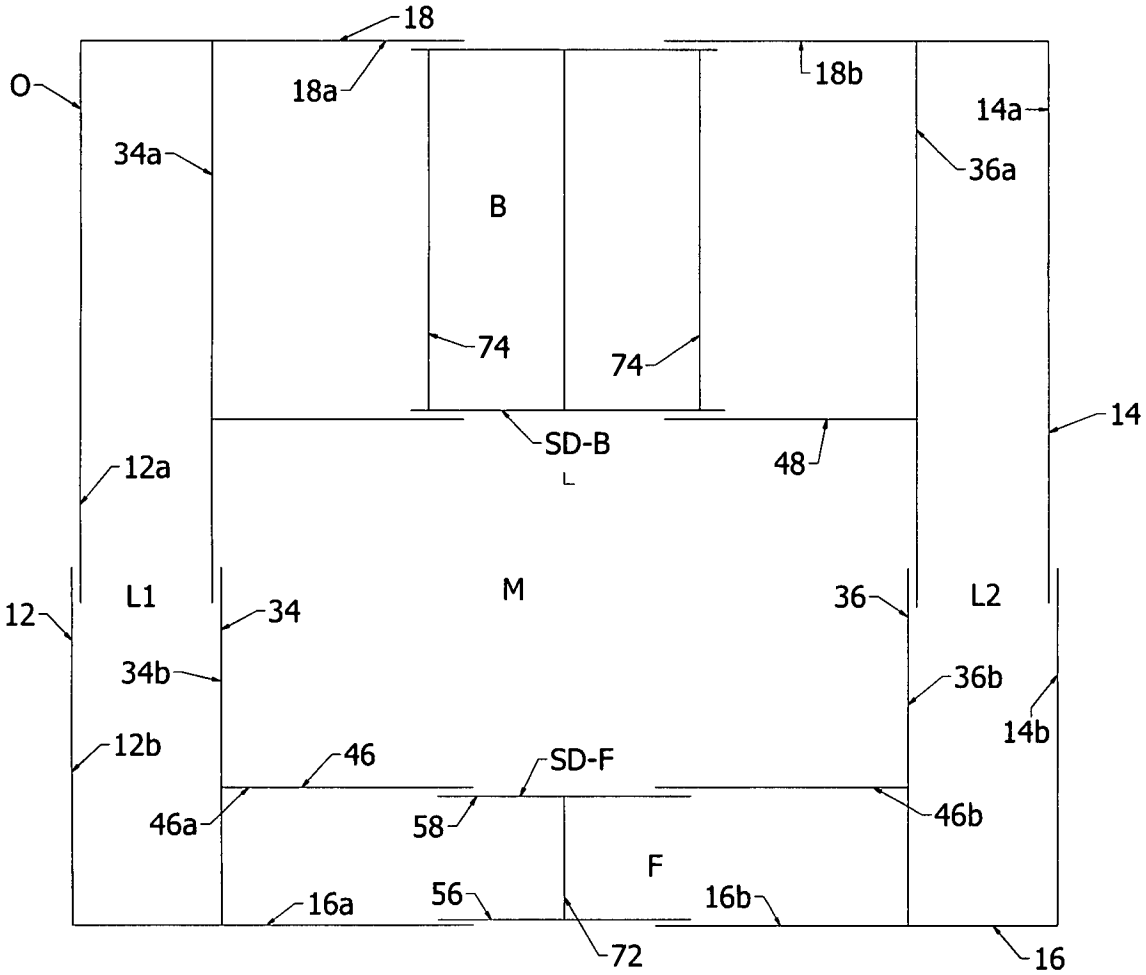
FIG. 1 is a schematic representation of the upstanding walls of the container.

With reference to FIG. 1, the adjustable container of the invention consists of a perimeter generally "O" within which are a pair of lateral compartments "L1" and "L2" on opposite sides of the perimeter, front and back compartments "F" and "B", respectively and a middle compartment "M" around which compartments L1, L2, F and B are arrayed.

The perimeter O is rectangular in shape and is enclosed at its sides by a pair of so-called "first" lateral walls 12, 14 and at its front and back by "first" front and "first" back walls 16, 18, respectively. Each lateral wall is composed of a pair of "first" outside lateral panels 12*a,b* and 14*a,b* which slide relative to each other for lengthening and shortening the effective length of the lateral walls. The front and back walls each is provided with a pair of outside "first" front panels 16*a,b* and outside "first" back panels 18*a, b*, respectively but these panels do not comprise the entire front and back walls unless the components of the adjustable container are fully retracted as is explained below.

Figure 2:
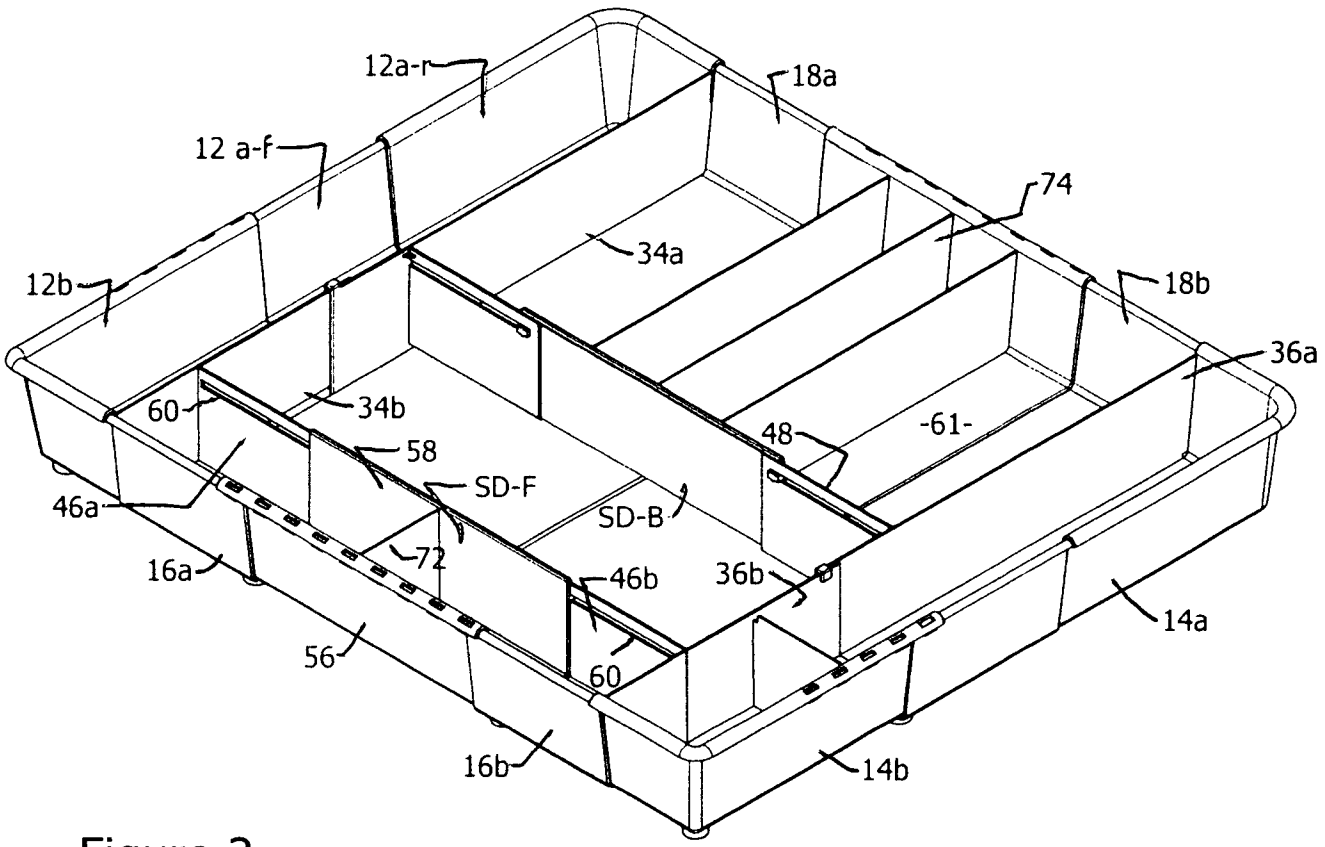
FIG. 2 is a perspective view of the container.
Figure 3:
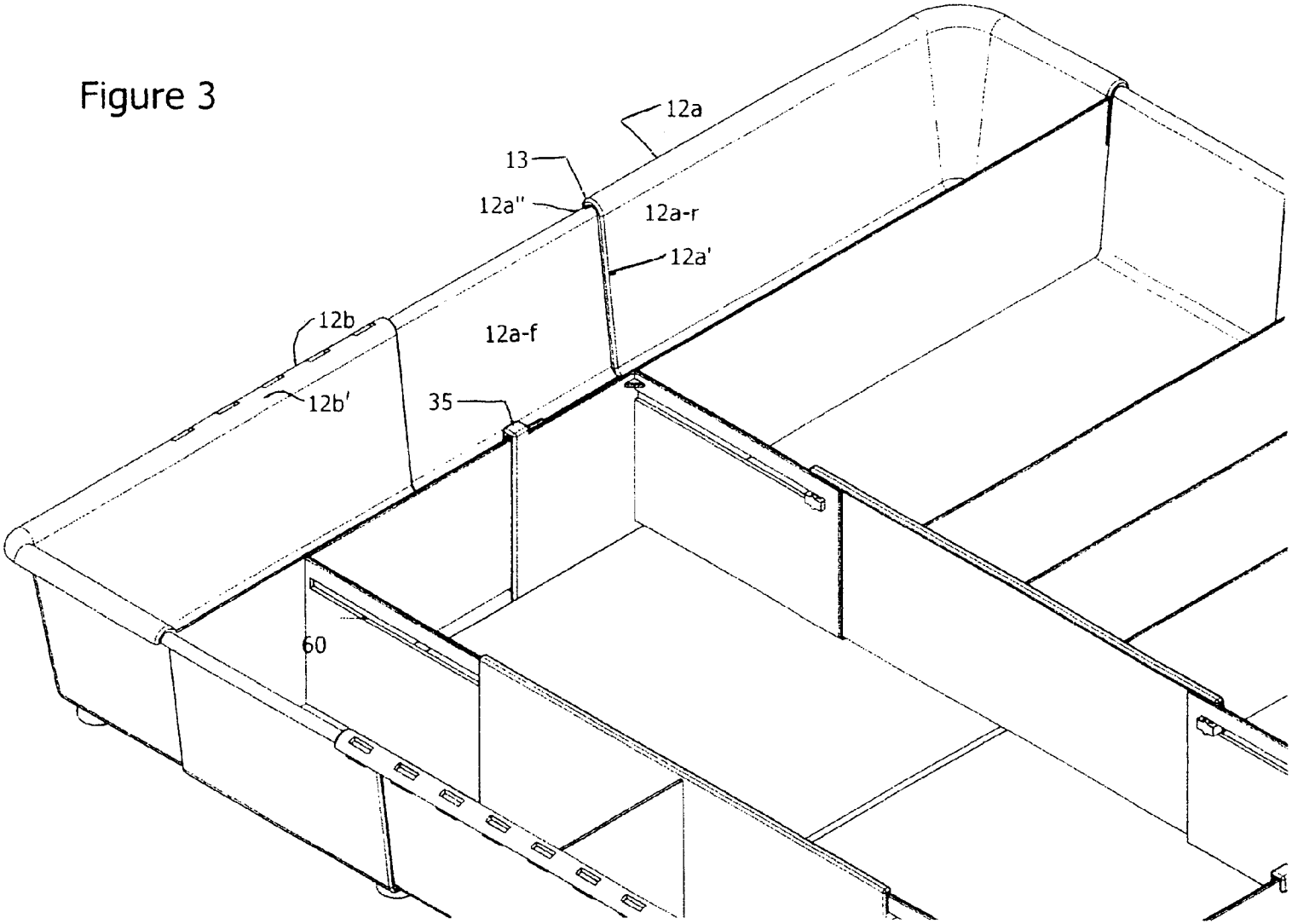
FIG. 3 is an enlarged perspective view of a portion of the interior of the container.

With reference to FIGS. 1-3, outside lateral panel 12*a* is composed of two sections a back section 12*a-r* and a front section 12*a-f*. The two sections are parallel but offset from one another and are interconnected at a junction, generally 13. At the junction, back section 12*a-r* terminates at an edge or shoulder 12*a*' which extends inwardly from the front section 12*a-f*. The shoulder extends vertically from the bottom to the top edges of the section and curls over its top edge at 12*a*".

Outside lateral panel 12*b* is aligned with back section 12*a-r* and slides toward and away from the latter section in the direction of the arrow in FIG. 3. Shoulders 12*a*' and 12*a*" define a stop point for the outside lateral panel 12*b* while the front section 12*a-f* serves as a guide for the latter panel. To that end, the upper edge of the outside lateral panel 12*b* is curled over at 12*b*' within which the upper edge of the front section 12*a-f* is slidingly accommodated.

First lateral wall 14 has the same construction as the first lateral wall 12. Accordingly outside lateral panels 14*a, b* slide relative to each other in the same manner as do outside panels 12*a,b* of the first lateral wall 12.

Figures 4A, 4B:
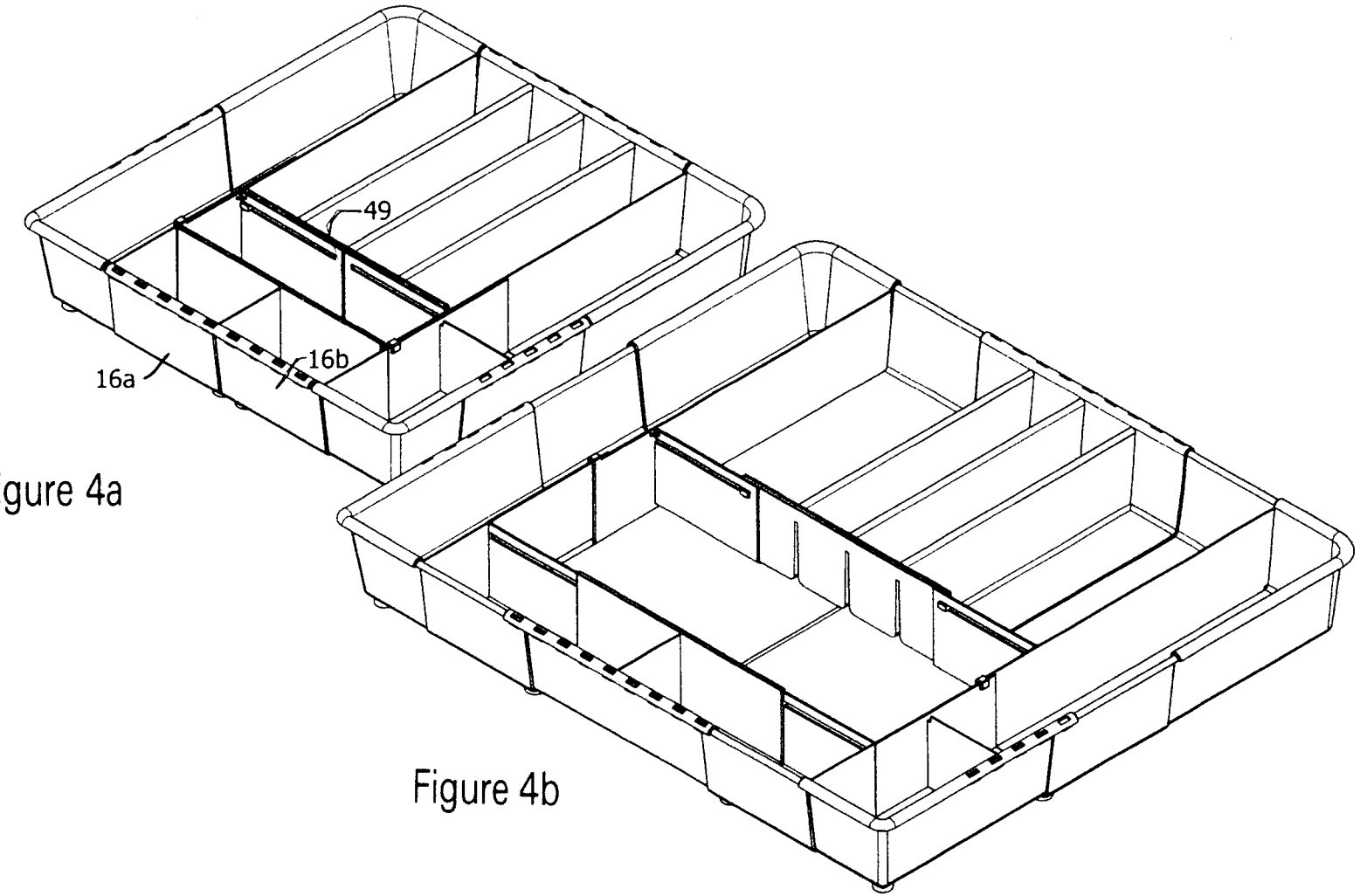
FIGS. 4*a* and 4*b* are perspective views of the container when the effective lengths of its adjustable components are at a minimum (FIG. 4*a*) and at a maximum (FIG. 4*b*)

The outside front panels 16*a,b* each have the same construction as outside lateral panel 12*a* as do outside back panels 18*a,b*. As illustrated in FIG. 4*a*, the forward edges of the outside the front panels contact each other when the adjustable container is in its fully contracted position and separate from each as illustrated in FIG. 4*b* as the container is expanded laterally. Likewise the forward edges (not illustrated) of the outside back panels 18*a,b* contact each other when the container is fully contracted and separate from each other when the container is expanded, Compartments L1 and L2 are disposed within the perimeter adjacent to each of its lateral walls 12, 14 and both compartments L1, L2 are of the same construction. As previously mentioned, compartment L1 is bounded at its outer side by outside panels 12*a,b* of the first lateral wall 12 while its inner side is bounded by a so-called "second" lateral wall 34. The latter wall is composed of a pair of inside lateral panels 34*a,b* and slide relative to each other while second lateral wall 36 is composed of a pair of inside lateral panels 36*a,b*. The effective length of lateral compartments L1 and L2 accordingly expands and contracts by adjustment of the effective length of first and second lateral walls 12, 34 and 14, 36, respectively.

Middle compartment, generally M, is disposed roughly centrally within the perimeter. The middle compartment is bounded at its sides by portions of the second lateral walls generally 34, 36. As the effective length of the latter walls varies so too does the effective length of the middle compartment.

The front and back walls of the middle compartment are bounded by so-called "third" front and "third" back walls, generally 46, 48 respectively. Both walls are of the same construction. Wall 46 is composed of a pair of "third" front panels 46*a,b* which are attached, at their back edges, to inside lateral panels 34*b*, 36*b* respectively. Their forward edges contact each other when the container is fully retracted as illustrated in FIG. 4*a*.

As the subject container expands, the forward edges of the front panels separate from one another and the expanding gap between them is closed by a front sliding divider, generally SD-F. The slider includes a parallel upstanding forward and back so-called "fourth" panels 56, 58 respectively. The forward panel 56 is adjacent to the first front panels 16*a,b* of the container and functions to close the gap between the front panels while the back panel 58 of the slider functions to close the gap between the third front panels 46*a,b*.

The back panel 58 of slider SF-F is connected for sliding to the third front panels 46*a,b* by pins (not illustrated) which are affixed to the back panel and travel along slots 60 in the third front panels 46*a,b*.

A back sliding divider SD-B of the same construction as sliding divider SD-F is mounted for sliding within back compartment B between first back panels 18*a,b* and the panels of third back wall 48. Slider SD-B functions to close the gap between the first and third back panels.

The front sliding divider SF-f has a single upright partition 72 while the back sliding divider SD-B has three upright partitions 74. The number of partitions and their spacing is a matter of choice. It should be noted however that the space between the outermost partition 74 of the back slider SD-B and panels 34*a*, 36*a*, is adjustable while the space between the partitions themselves is not. The space between partitions 72 of slider SD-F and the side limits of the front compartment F is of course adjustable.

Figure 5:
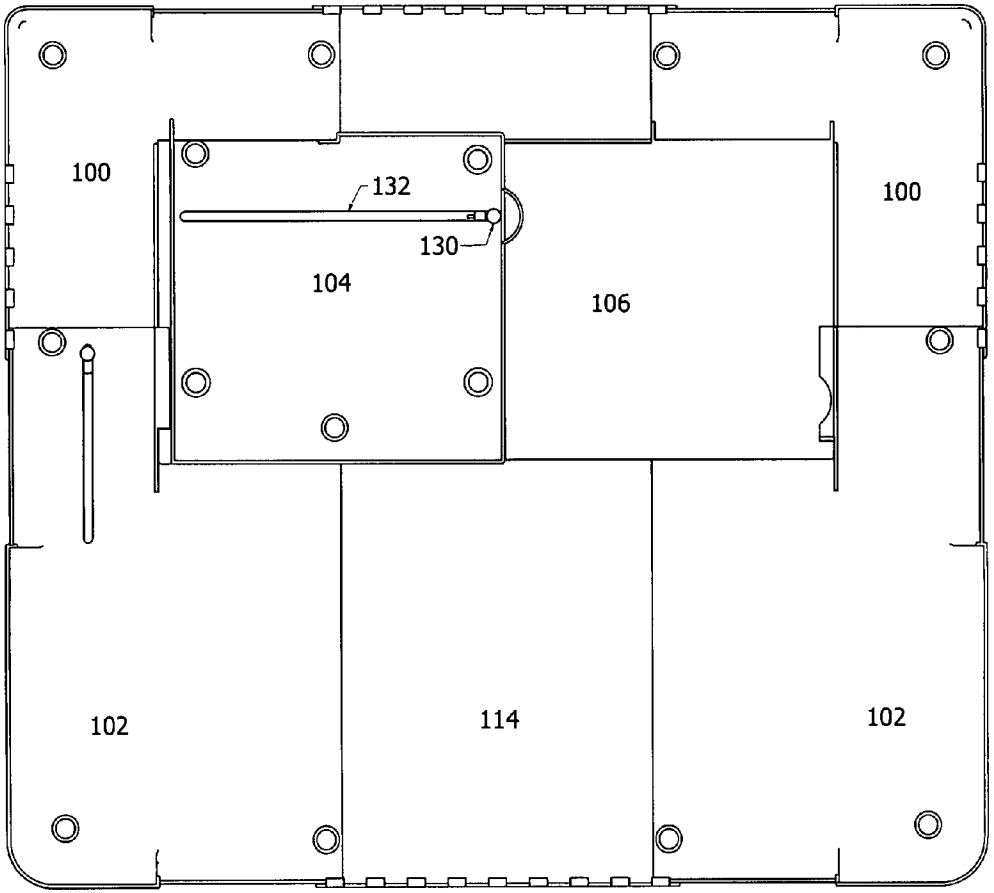
FIG. 5 is a schematic representation of the floor or basal panels of the container.

With reference to FIG. 5, lying at the bottom of compartment L1, L2 and M is a bottom wall or floor composed of two basal segments which slide over or under adjacent basal segments as the length or width of the compartments is adjusted. In each lateral compartments L1 or L2 there are only two basal segments 100, 102, the former of which extends between outside and inside lateral panels 12*a*, 34*a* and the latter between outside and inside lateral panels 12*b*, 34*b*. In the middle compartment M, there are two basal segments 104,106. As the effective length of the lateral compartments is shortened, and the effective width of the middle compartment is shortened, one basal segment in each lateral compartment and in the middle compartment slides over the other.

In compartments F and B, there are three "third" basal segments, 102 (counting both lateral compartment) and 114, the latter constituting the floor of sliders SF-F and SD-B.

Once the effective length and width of the outer walls which define the perimeter of the drawer organizer have been adjusted to fit into a drawer, the walls can be interlocked to immobilize them as well as all the internal walls of the device. To this end, a number of threaded locking pins 130 are received in openings formed in the basal panels. Elongated grooves 132 are formed in basal panels adjacent to the panels in which the pins are received. As the basal panels slide relative to each other the pins travel in the grooves and can be immobilized by means of conventional locking nuts.

Figure 7:
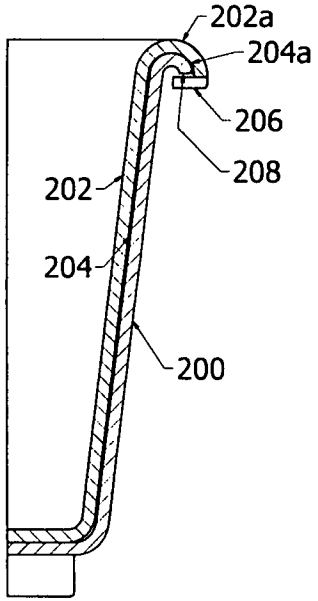
FIG. 7 is a section on line 7-7 of FIG. 6
Figure 6:
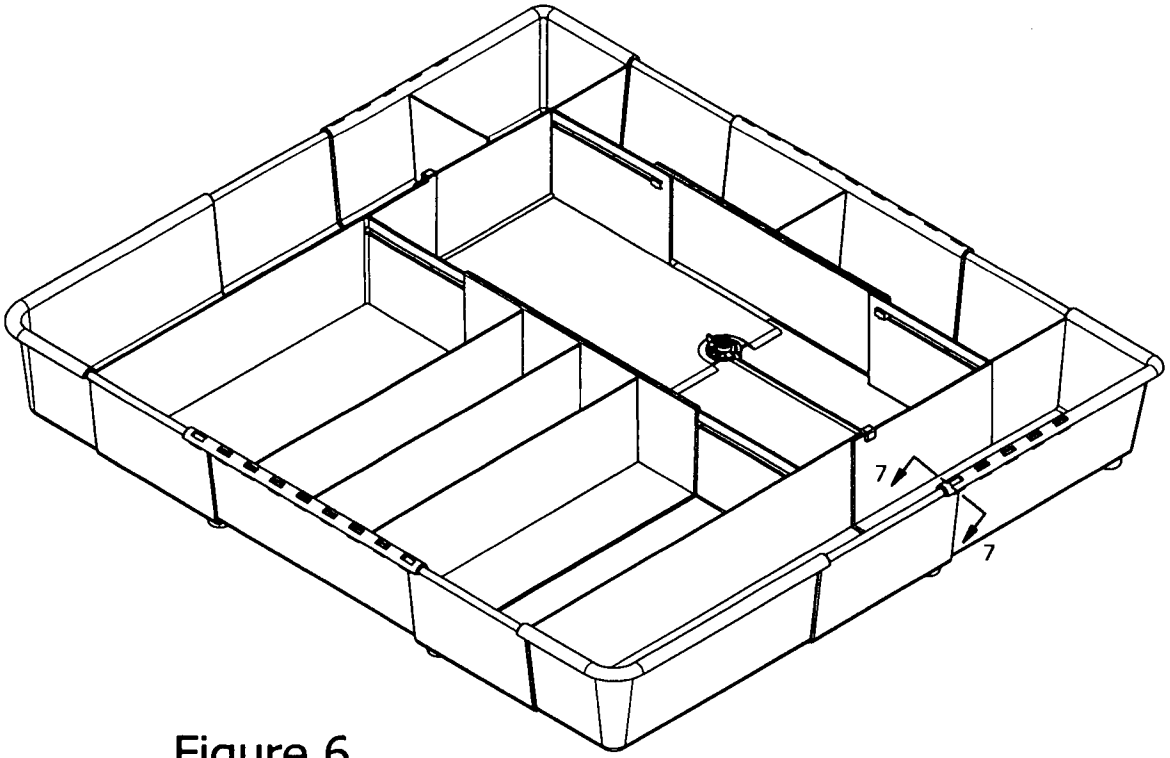
FIG. 6 is a perspective view of a corner of the container in which its outer walls have rounded upper edges.

With reference to FIGS. 6 and 7, perimeter 200 of the drawer organizer is composed of inner and outer panels 202, 204 which lie in separate parallel planes and which slide relative to each other. The panels have rounded upper portions or shoulders 202*a* and 204*a* respectively, which extend outwardly of the planes. The two rounded shoulders accordingly extend on a curve which projects outwardly of the drawer organizer itself. Shoulders portion 202*a* is above shoulders 204*a* and the two shoulders remain adjacent to each other as the panels slide relative to each other. Shoulders 202*a* of the inner panel terminates at an inwardly extending wall 206 which is located beneath the downwardly facing edge 208 of shoulder 204*a*, The latter shoulders is accordingly surrounded by shoulders 202*a*, 206.

Figure 8:
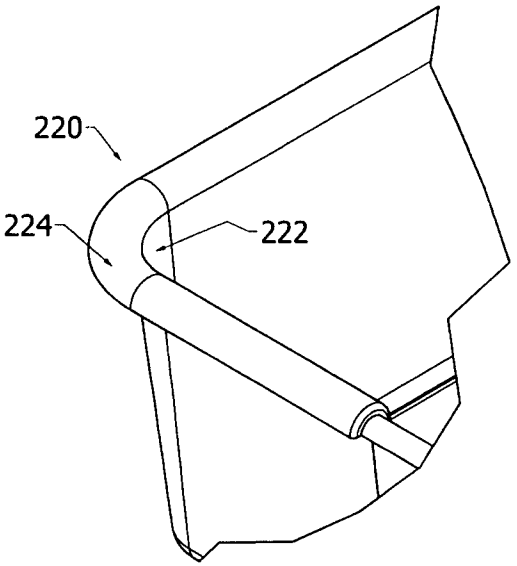
FIG. 8 is a perspective view of the portion of the corner illustrated in FIG. 6.
Figure 9:
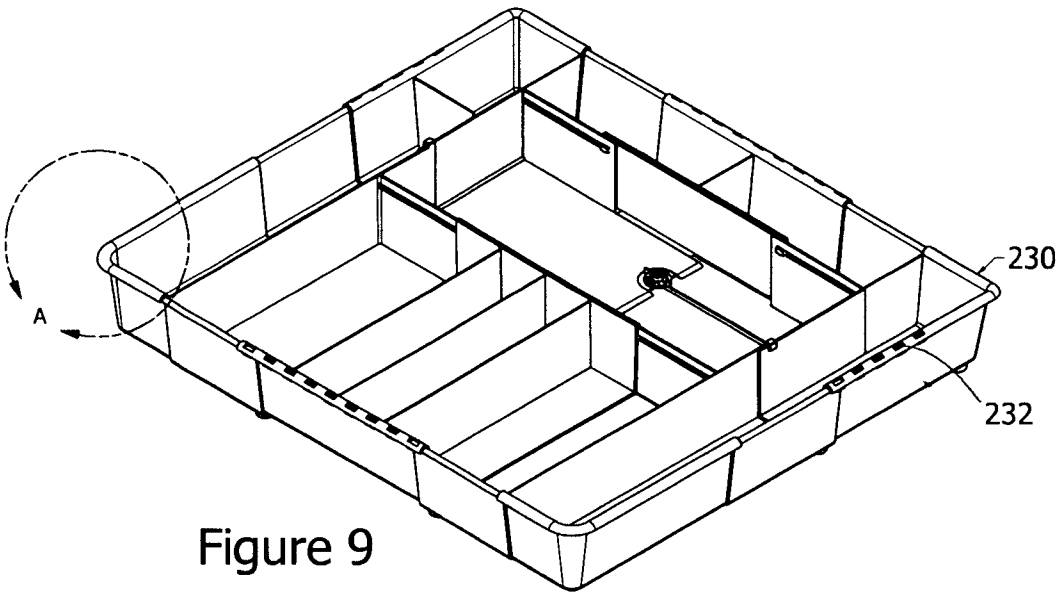
FIG. 9 is a perspective view of an entire drawer organizer in which its outer walls have rounded upper edges'

With reference to FIGS. 8 and 9, the outer corners, generally 220 of the drawer organizer are each composed of a curved wall 222 having a rounded shoulder 224. In FIG. 9, the rounded upper portions 230 have openings 232 spaced apart along their lengths to facilitate moulding of the panels.

Figure 10:
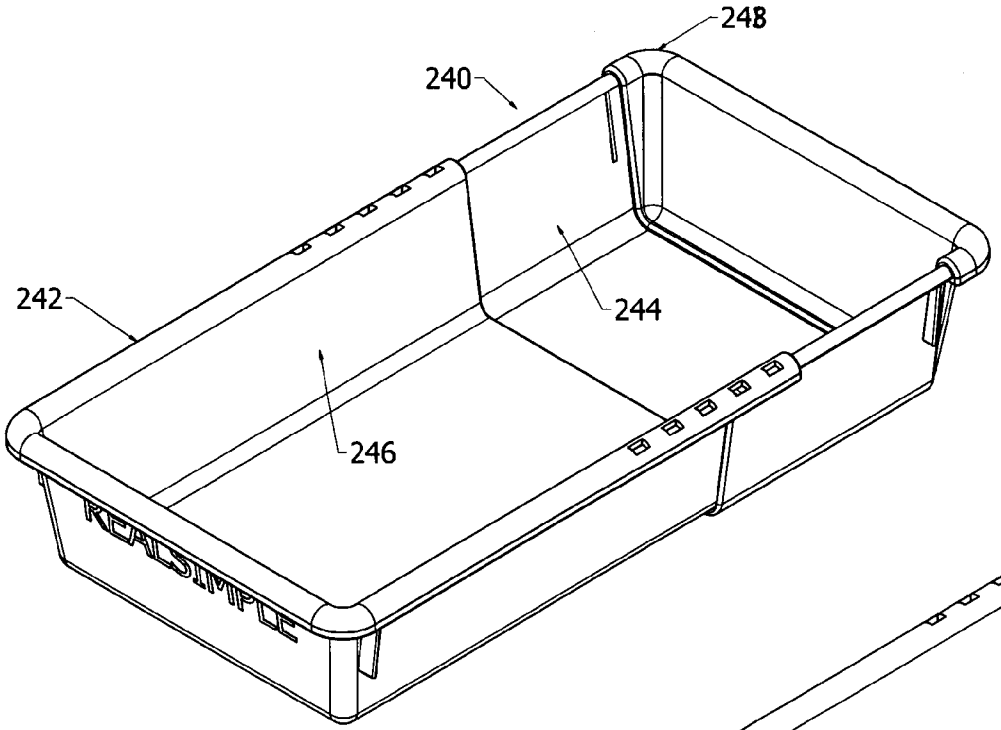
FIG. 10 is a perspective view of a container which lacks internal compartments in an open position.

In FIG. 10, a container, generally 240 composed of a single compartment has lateral walls, generally 242 each composed of an outer or first panels 244 and an inner or second panels 246 which, like the drawer organizers described above, lie in separate parallel planes and which slide relative to each other for lengthening and shortening the effective length of the lateral walls of the container. By the same means previously described with reference to the drawer organizer of FIGS. 6 to 9, the shoulders of panels 244, 246 and the corners 248 are rounded.

Figure 11:
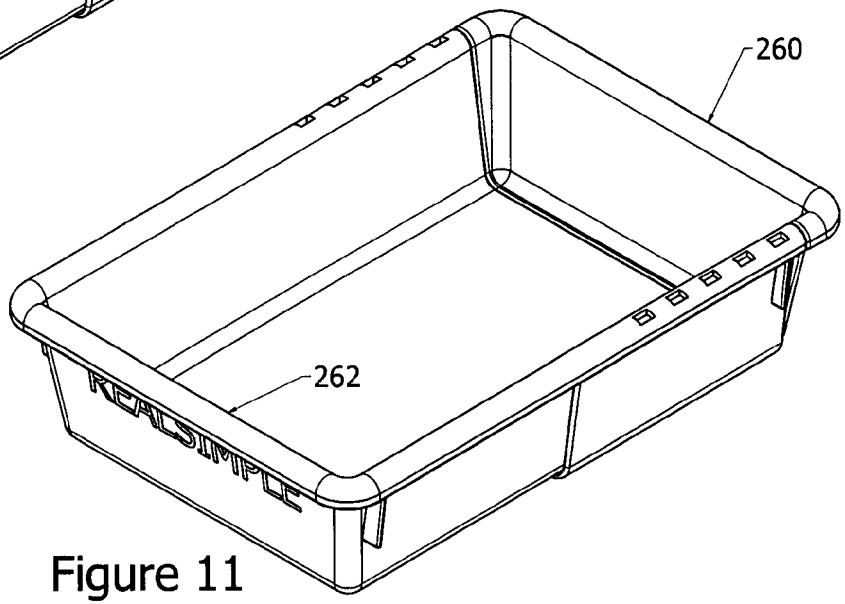
FIG. 11 is the container of FIG. 10 is a closed position.

In FIG. 11, the effective length of the lateral walls of the container is extended by sliding one panel relative to the other on each side the container. The front and back walls 260, 262 of the container can be provided with sliding panels so that both its width and its length can be expanded or contracted.

The container of FIGS. 10 and 11 is suitable for use not only as a drawer organizer but for other purposes where an expandible container would be useful.

It will be understood, of course, that modifications can be made in the structure of the expandible container of the subject invention without departing from the scope and purview of the invention as defined in the appended claims.

I claim:

1. An expandible container for use as an adjustable drawer organizer for segregating articles within a drawer including: (i) a rectangular perimeter composed of a pair of substantially parallel first lateral walls and substantially parallel first front and first back walls, the effective length of each said first lateral wall and said first front and back walls being adjustable; (ii) a pair of lateral rectangular compartments disposed within said perimeter and each having an adjustable length; (iii) front and back rectangular compartments disposed within said perimeter and each having an adjustable width; and (iv) a middle rectangular compartment having an adjustable length and width, said middle compartment being within and entirely surrounded by said lateral compartments and said front and back compartments.

2. The expandible container of claim 1 wherein each said first lateral wall is composed of a pair of first aligned panels which are adapted to slide together and apart, one said first panel having a section which extends toward the other said first panel and is arranged and constructed such that as said first panels slide toward each other, said section guides said other first panel into an abutting side-by-side relationship with said one first panel, said first panels each having a shoulder provided with a curved upper wall, said shoulders being arranged and constructed such that when said first panels are in an abutting relationship, said upper walls form a continuous surface which extends the length of said first panels.

3. An expandible container for use as an adjustable drawer organizer for segregating articles within a drawer including: (i) a rectangular perimeter composed of a pair of substantially parallel first lateral walls and by substantially parallel first front and first back walls, the effective length of each said first lateral wall and said first front and back walls being adjustable; (ii) a pair of lateral rectangular compartments disposed within said perimeter and each bounded at a side by a separate said first lateral wall and at an opposite side by a second lateral wall, the effective length of said second lateral wall being adjustable with resulting adjustability of the length of said lateral compartments; (iii) front and back rectangular compartments disposed within said perimeter and each bounded at opposite sides by side walls and at the front and back, by a segment of said first front wall and a segment of said first back wall, respectively, the lengths of said segments being adjustable said front compartment being bounded at the back by a third front wall parallel with said first front wall, the effective width of which being adjustable with resulting adjustability of the width of said front compartment, said back compartment being bounded at the front by a third back wall parallel to said first back wall, the effective width of which being adjustable with resulting adjustability of the width of said back compartment; and (iv) a middle rectangular compartment within and entirely surrounded by said lateral compartments and said front and back compartments, said middle compartment being bounded at each side by an adjustable portion of said second lateral wall, at the front by said third front wall and at the back by said third back wall such that the effective length and width of said middle compartment are adjustable.

4. The expandible container of claim 3 further including a front sliding divider disposed within said front compartment and composed of fourth forward and fourth rear panels disposed adjacent to said first and third front walls, respectively, said sliding divider including a partition extending between said forward and rear fourth panels, said sliding divider being slidably laterally with resulting adjustment in the distance between said partition and said side walls of said front compartment.

5. The expandible container of claim 3 further including a back sliding divider disposed within said back compartment and composed of fourth forward and fourth rear panels disposed adjacent to said first and third back walls, respectively, said back sliding divider including a plurality of partitions extending between said forward and rear fourth panels, said sliding divider being slidable laterally with resulting alteration in the distance between the partitions and said side walls of said back compartment.

6. The expandible container of claim 3 further including a pair of first basal segments formed in each said lateral compartment, each said first basal segment extending between each of said first and second lateral walls which face one another in each one of said lateral compartments, said first basal segments in each said lateral compartment slidable relative to one another.

7. The expandible container of claim 6 further including a pair of basal segments in each said compartment, each said pair being slidable relative to one another and each having means for selectively preventing adjacent said basal segments from sliding relative to each other.

8. The expandible container of claim 3 further including a pair of second basal segments formed in said middle compartment, each said second basal segment extending between said third front wall and said third back wall.

9. The expandible container of claim 3 further including a pair of third basal segments formed in each of said front and back compartments, one pair of said third basal segments extending between said first and third front walls and the other pair of said third basal segments extending between said first and third back walls.

10. An expandible container for use as an adjustable drawer organizer for segregating articles within a drawer including: (i) a rectangular perimeter composed of a pair of substantially parallel first lateral walls and substantially parallel first front and first back walls, the effective length of each said first lateral wall and said first front and back walls being adjustable, (ii) a pair of lateral rectangular compartments disposed within said perimeter and each having an adjustable length; (iii) front and back rectangular compartments disposed within said perimeter and each having an adjustable width; (iv) a middle rectangular compartment disposed within said lateral compartments and said front and back compartments, said middle compartment having an adjustable length and width; and (v) a front sliding divider disposed within said front compartment and composed of fourth forward and fourth rear panels disposed adjacent to said first and third front walls, respectively, said sliding divider including a partition extending between said forward and rear fourth panels, said sliding divider being slidable laterally with resulting adjustment in the distance between said partition and said side walls of said front compartment.

11. An expandible container for use as an adjustable drawer organizer for segregating articles within a drawer including: (i) a rectangular perimeter composed of a pair of substantially parallel first lateral walls and substantially parallel first front and first back walls, the effective length of each said first lateral wall and said first front and back walls being adjustable, (ii) a pair of lateral rectangular compartments disposed within said perimeter and each having an adjustable length; (iii) front and back rectangular compartments disposed within said perimeter and each having an adjustable width; (iv) a middle rectangular compartment disposed within said lateral compartments and said front and back compartments, said middle compartment having an adjustable length and width; and (v) a back sliding divider disposed within said back compartment and composed of fourth forward and fourth rear panels disposed adjacent to said first and third back walls, respectively, said back sliding divider including a plurality of partitions extending between said forward and rear fourth panels, said sliding divider being slidable laterally with resulting alteration in the distance between said partitions and said side walls of said back compartment.

12. An expandible container for use as an adjustable drawer organizer for segregating articles within a drawer including: (i) a rectangular perimeter composed of a pair of substantially parallel first lateral walls and substantially parallel first front and first back walls, the effective length of each said first lateral wall and said first front and back walls being adjustable, (ii) a pair of lateral rectangular compartments disposed within said perimeter and each having an adjustable length; (iii) front and back rectangular compartments disposed within said perimeter and each having an adjustable width; (iv) a middle rectangular compartment disposed within said lateral compartments and said front and back compartments, said middle compartment having an adjustable length and width; and (v) a pair of second basal segments formed in said middle compartment, each said second basal segment extending between said third front wall and said third back wall.

13. An expandible container for use as an adjustable drawer organizer for segregating articles within a drawer including: (i) a rectangular perimeter composed of a pair of substantially parallel first lateral walls and substantially parallel first front and first back walls, the effective length of each said first lateral wall and said first front and back walls being adjustable, (ii) a pair of lateral rectangular compartments disposed within said perimeter and each having an adjustable length; (iii) front and back rectangular compartments disposed within said perimeter and each having an adjustable width; (iv) a middle rectangular compartment disposed within said lateral compartments and said front and back compartments, said middle compartment having an adjustable length and width; and (v) a pair of third basal segments formed in each of said front and back compartments, one pair of said third basal segments extending between said first and third front walls and the other pair of said third basal segments extending between said first and third back walls.

14. An expandible container for use as an adjustable drawer organizer for segregating articles within a drawer including: (i) a rectangular perimeter composed of a pair of substantially parallel first lateral walls and substantially parallel first front and first back walls, the effective length of each said first lateral wall and said first front and back walls being adjustable; (ii) a pair of lateral rectangular compartments disposed within said perimeter and each bounded at a side by a separate said first lateral wall and at an opposite side by a second lateral wall, the effective length of said second lateral wall being adjustable with resulting adjustability of the length of said lateral compartments; (iii) front and back rectangular compartments disposed within said perimeter and each bounded at opposite sides by side walls and at the front and back, by a segment of said first front wall and a segment of said first back wall, respectively, the lengths of said segments being adjustable, said front compartment being bounded at the back by a third front wall parallel with said first front wall, the effective width of which being adjustable with resulting adjustability of the width of said front compartment, said back compartment being bounded at the front by a third back wall parallel to said first back wall, the effective width of which being adjustable with resulting adjustability of the width of said back compartment; (iv) a middle rectangular compartment disposed adjacent to said lateral compartments and said front and back compartments, said middle compartment being bounded at each side by an adjustable portion of said second lateral wall, at the front by said third front wall and at the back by said third back wall such that the effective length and width of said middle compartment are adjustable; and (v) a pair of first basal segments formed in each said lateral compartment, each said first basal segment extending between each of said first and second lateral walls which face one another in each one of said lateral compartments, said first basal segments in each said lateral compartment slidable relative to one another.

15. An expandible container for use as an adjustable drawer organizer for segregating articles within a drawer including: (i) a rectangular perimeter composed of a pair of substantially parallel first lateral walls and substantially parallel first front and first back walls, the effective length of each said first lateral wall and said first front and back walls being adjustable; (ii) a pair of lateral rectangular compartments disposed within said perimeter and each bounded at a side by a separate said first lateral wall and at an opposite side by a second lateral wall, the effective length of said second lateral wall being adjustable with resulting adjustability of the length of said lateral compartments; (iii) front and back rectangular compartments disposed within said perimeter and each bounded at opposite sides by side walls and at the front and back, by a segment of said first front wall and a segment of said first back wall, respectively the lengths of said segments being adjustable, said front compartment being bounded at the back by a third front wall parallel with said first front wall, the effective width of which being adjustable with resulting adjustability of the width of said front compartment, said back compartment being bounded at the front by a third back wall parallel to said first back wall, the effective width of which being adjustable with resulting adjustability of the width of said back compartment; (iv) a middle rectangular compartment being bounded at each side by an adjustable portion of said second lateral wall, at the front by said third front wall and at the back by said third back wall such that the effective length and width of said middle compartment are adjustable; (v) a pair of first basal segments formed in each said lateral compartment, each said first basal segment extending between each of said first and second lateral walls which face one another in each one of said lateral compartments, said first basal segments in each said lateral compartment slidable relative to one another; and (vi) a pair of third basal segments formed in each said front and back compartments, each said third pair being slidable relative to one another and each having means for selectively preventing adjacent said third basal segments from sliding relative to each other.

* * * * *